United States Patent [19]

Grashow et al.

[11] Patent Number: 4,462,033

[45] Date of Patent: Jul. 24, 1984

[54] ANTENNA WITH SPRING LOADING COIL

[75] Inventors: Joseph Grashow, Brooklyn; Melvin J. Berg, Tappan; Joseph L. Dubovy, Peekskill; Stanley J. Grashow, Nanuet, all of N.Y.

[73] Assignee: Quick-Mount Manufacturing Co., Inc., Brooklyn, N.Y.

[21] Appl. No.: 927,489

[22] Filed: Jul. 24, 1978

Related U.S. Application Data

[63] Continuation of Ser. No. 756,239, Jan. 3, 1977, abandoned.

[51] Int. Cl.[3] ..... H01Q 1/20; H01Q 9/32

[52] U.S. Cl. ..... 343/715; 343/749

[58] Field of Search ..... 343/749–752, 343/745, 895, 715, 802

[56] References Cited

U.S. PATENT DOCUMENTS

| | | | |
|---|---|---|---|
| 2,719,920 | 10/1955 | Ellis | 343/715 |
| 2,982,964 | 5/1961 | Bresk et al. | 343/750 |
| 3,249,945 | 5/1966 | Lewis | 343/749 |
| 3,438,046 | 4/1969 | Menhenett | 343/750 |
| 3,541,554 | 11/1970 | Shirey | 343/745 |
| 3,623,113 | 11/1971 | Faigen et al. | 343/747 |
| 3,624,662 | 11/1971 | Feder | 343/715 |
| 4,101,898 | 7/1978 | Ingram | 343/715 |

OTHER PUBLICATIONS

Hick, CB Radio Antennas, Howard W. Sams & Co. and the Bobbs-Merrill Co., p. 39, (1976).

*Primary Examiner*—Eli Lieberman

*Attorney, Agent, or Firm*—Brumbaugh, Graves, Donohue & Raymond

[57] ABSTRACT

A transmitting and receiving antenna, e.g. a mobile C.B. antenna, has a whip radiator connected to a loading coil, both of which are supported above a ground plane by a mounting structure. The loading coil is made from a simple helical spring partially compressed and retained between conductive end pieces located at the ends of a cylindrical dielectric tube. A savings in labor is achieved because no solder or like connections are needed in constructing the loading coil.

3 Claims, 3 Drawing Figures

ANTENNA WITH SPRING LOADING COIL

This is a continuation of application Ser. No. 756,239 filed Jan. 3, 1977, now abandoned.

BACKGROUND OF THE INVENTION

The present invention relates to transmitting and receiving antennas, and, more particularly, to mobile C.B. antennas equipped with loading coils.

Antennas of the simple rod type are most efficient when they have a length equivalent to the wavelength of the signal they are to receive or transmit. Citizen band (C.B.) radio transmissions, which have become extremely popular in recent years, are conducted at the 27 MHz channel, i.e. an 11 meter or approximately 36 foot wavelength. Naturally it would be impractical to have such a long antenna mounted on a vehicle. However, it is well known that a rod type monopolar antenna is most efficient when it is equivalent to a quarter wavelength and counterposed against another quarter wavelength section or a metallic surface (e.g. a vehicle body) which acts as an additional quarter wavelength. While a quarter wavelength antenna is much more acceptable, it is still a bit too long for most vehicles and it is the practice to make C.B. antennas in the range of 3 to 4 feet in length. When this is done the impedance of the antenna as seen by the transmitter-receiver (transceiver) is altered.

For maximum power transfer from the transceiver to the antenna, the output impedance of the transmitter section of the transceiver, the characteristic impedance of the connecting cable and the impedance of the antenna should all be matched and should appear to be resistive. The degree of mismatch and, hence, the efficiency of the antenna system is given by the voltage standing wave ratio (VSWR). When the ratio is 1:1 all of the output power of the transmitter section is delivered to the antenna. However, a VSWR of some other value indicates that some of the transmitter power is reflected from the antenna back to the transmitter and is never radiated.

In order to compensate for the capacitive reactance of a short C.B. antenna, which produces an impedance that differs from the ideal impedance and results in a poor VSWR, an inductive loading coil is included in the antenna system. This coil cancels the capacitive reactance and makes the antenna appear to have the proper impedance, i.e. electrically the antenna appears longer.

A typical loading coil is in the form of conducting wire that is carefully wrapped about a form or core. The ends of the wire are then soldered or fastened, e.g. by means of screws, onto the other conducting parts of the antenna. Such a loading coil is shown in U.S. Pat. No. 2,719,920 to G. R. Ellis. A loading coil without a core, but whose turns are covered with a vinyl jacket, is disclosed on page 39 of *C.B. Radio Antennas* by David E. Hicks. In either case considerable effort is expended to get and maintain the correct number of turns with the right spacing for these coils. Although these coils have the desired affect of cancelling the capacitance reactance, it has been found that their high Q limits the band width of the antenna. Also, they are relatively expensive and the connection of the coil to the rest of the antenna requires a good deal of labor and represents an additional expense.

Simple springs, while not designed to be inductors, nevertheless do possess some inductance and have been used as such. In particular, U.S. Pat. No. 2,982,964 to R. H. Bresk et al. discloses a receiving antenna system that uses a tapered multi-turn spring which can be compressed to change its physical length and inductance, thereby tuning the receiving antenna. The spring is made of spring wire and in one embodiment its upper end is welded to a whip which passes through its center. In another version the spring is enclosed in a conducting housing, so that it cannot radiate, and the receiving antenna connection extends into this housing. U.S. Pat. No. 3,624,662 to A. Feder describes the use of a coil spring compressed within a dielectric sleeve as a phasing coil for a mobile radio transmitting and receiving antenna, i.e. the spring acts as a delay line so that the current distribution between the upper and lower sections of the antenna can be matched. Although one end of the spring freely rests against a conducting member at the top of the antenna, the other end is firmly attached to a sleeve.

A less expensive antenna, capable of transmitting in the C.B. band, could be designed if a method were found for using simple springs as the transmission loading coil. Even more material and labor savings could be realized if this spring could be installed in the antenna without any solder, weld or the like type of connection between the spring and the rest of the antenna.

SUMMARY OF THE INVENTION

The present invention is directed to improving the effectiveness of and reducing the cost of transmitting and receiving antennas by the use of a partially compressed spring, which is held in place only by a nonconducting housing with conducting end pieces, as a loading coil. This results in a savings in material and labor because welding or soldering equipment is not needed and the coil can be assembled merely by dropping the spring into the housing and attaching the end pieces so as to compress the spring.

In an illustrative embodiment of the invention a whip-like elongated conducting rod is connected to one end of a loading coil and the other end of the coil is connected to a mounting structure, so as to form a transmitting and receiving antenna held above a ground plane. The loading coil is a helical spring made of a spring steel alloy and enclosed in a cylindrical plastic tube. Metal end pieces are located at either end of the tube.

The inside diameter of the tube is substantially the same as the outside diameter of the spring so that the spring is adequately supported and its inductance does not change appreciably when the antenna is subjected to the movement encountered when the vehicle to which it is attached is in motion. Also, the length of the housing between the two metal end pieces is less than the uncompressed length of the spring. This has the affect of assuring a good electrical connection between the ends of the spring and the rest of the antenna.

In a preferred embodiment the rod extends into the loading coil housing and contacts a movable plate within the housing. By adjusting the penetration of the rod into the housing the antenna can be tuned because of a change in the compression of the spring which results in a change in its overall length and the inductance of the spring.

For a mobile C.B. antenna an arrangement of four individual springs has been found to be particularly effective. These springs are made of spring steel and are coated with zinc. They have a 3 inch length, a $\frac{3}{8}$ inch outside diameter (O.D.) and a pitch of 11 turns per inch.

When confined within an 11 inch housing and combined with a 22 to 24 inch whip, depending on the size of the ground plane, these springs result in an antenna system that is efficient and has a 1:1.05 VSWR over the 23 C.B. channels.

BRIEF DESCRIPTION OF THE DRAWINGS

The foregoing and other features of the present invention will be more readily apparent from the following detailed description and drawings of illustrative embodiments of the invention in which.

DESCRIPTION OF EXEMPLARY EMBODIMENTS

Figure 1:
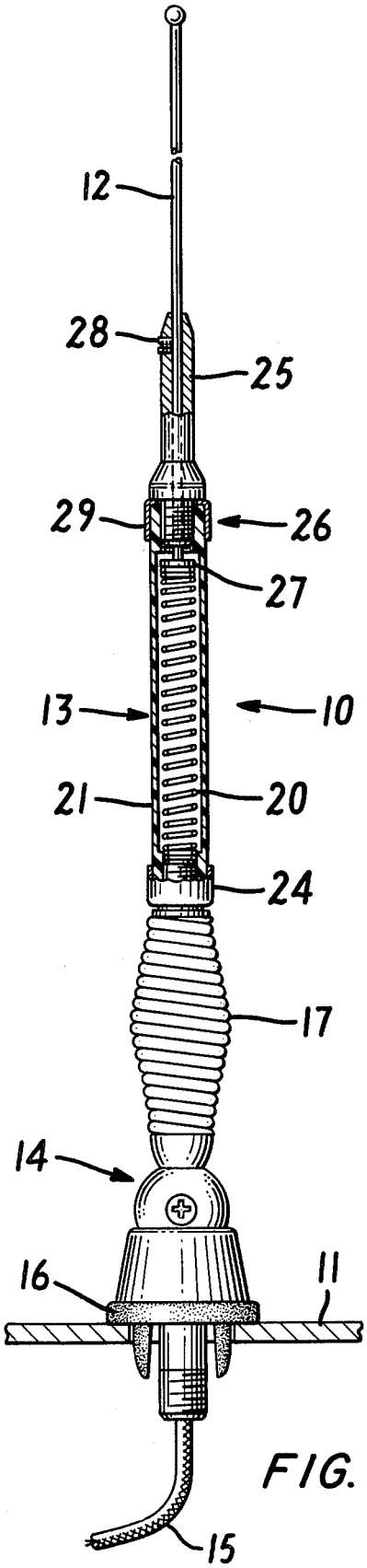
FIG. 1 is an illustrative embodiment of the invention using a single loading coil spring.

In FIG. 1 there is shown a mobile C. B. antenna 10 mounted above a ground plane 11, which plane may be the body of the vehicle on which the antenna is mounted. The antenna has an elongated rod or whip 12 that is connected to a loading coil 13. The whip and loading coil are in turn attached to the vehicle by a mounting structure 14. Electrical continuity is maintained in the antenna from the remote end of the whip to a cable 15 attached between the mounting base and the transceiver (not shown).

The mounting base 14 has an insulating member 16 that prevents it from making electrical contact with the ground plane. Also, a certain amount of mechanical flexibility is imparted to the antenna by means of a mounting spring 17.

Loading coil 13 comprises a helical spring 20 located within a nonconducting tubular housing 21. Metal end pieces 24 and 26 confine the spring 20 within an area smaller than its uncompressed length. Hence, the spring pushes against the end pieces, thereby establishing electrical contact through the loading coil without the necessity for solder, welded or the like connections.

If it is desired to adjust the antenna, the whip 12 may be designed so as to extend into the housing of the loading coil. In such a case the end piece 26 includes a mounting member 25, which is in electrical contact with an end cap 29. The whip extends through the member 25 and the end cap 29 to a circular conducting plate 27 located within the housing in contact with the loading spring.

By loosening an adjustment screw 28 in the member 25, the whip can be pushed into or withdrawn from the housing of the loading coil. The effect of this is to change the overall length of the antenna from the tip of the whip to the ground plane and also to change the compression of the spring 20. Since a change in the compression of the spring changes its inductance, the antenna can be tuned over a range of frequencies because of a change in its length and its reactive impedance.

The end cap 24 is mechanically fastened to the spring 17 of the mounting structure 14 and is also preferably attached to the dielectric loading coil housing 21. At the other end of the housing the cap 29 merely fits over its end. An opening is provided in cap 29 which is large enough to permit the whip to pass through and also to let a portion of member 25 mate with the interior of housing 21. Hence, in the assembly of an adjustable antenna, the spring 20 is dropped into the open end of the housing and the plate 27 is placed over it. Then the cap 29 is located over the end and member 25 is fixed within the housing 21, e.g. by a press fit or a screw connection. Threads may be provided on the plate 27 and the whip so that they may be screwed together after the whip is installed in the end piece. This provides a better connection between the whip and the loading coil. Screw 28 holds the whip in place while the assembly of the whip and end cap 26 is placed over the open end of the housing and then press fit on the housing. When it has been assembled, the length and/or the compression of spring 20 can be adjusted by moving the whip 12 and then locking it in place with screw 28. If it is desired to adjust the length of the antenna, which affects its frequency, without affecting the compression of spring 20, which affects its impedance, the whip can be made to terminate in the end piece 25 and the plate 27 can be eliminated. The length of the antenna would then be adjusted by cutting off pieces of the whip near its termination.

One advantage of the spring loading coil over the core-wound loading coils of the prior art is that there is no need to moisture proof the springs, if they are coated with a suitable conducting material. However, if it should be necessary, this can easily be done by sealing the end pieces on the coil housing.

Figure 2:
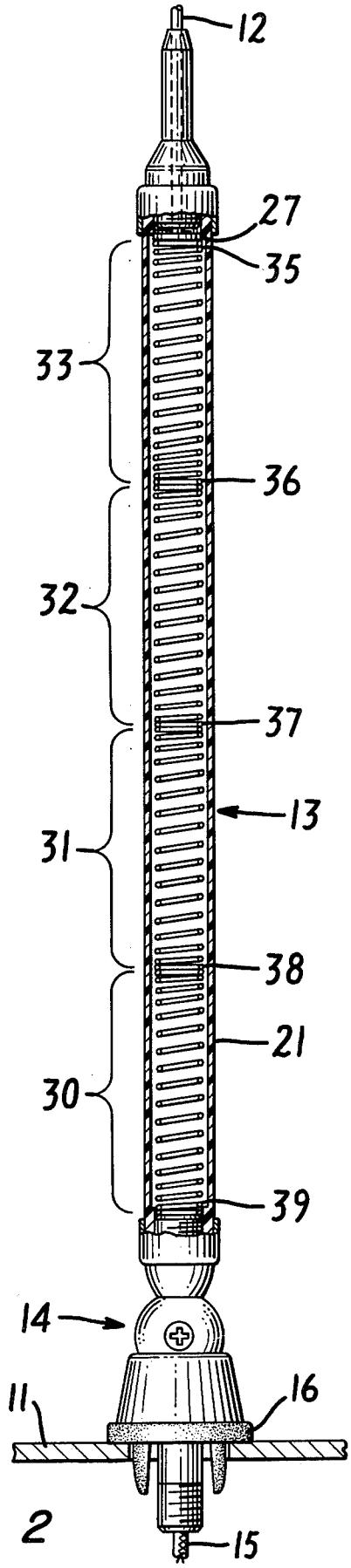
FIG. 2 is a modification of the embodiment of FIG. 1 in which four loading coil springs are used.

The embodiment of FIG. 2 is the same as that of FIG. 1, except that spring 20 has been replaced by four separate springs 30–33. These springs are not fastened together in any manner and have merely been slipped within housing 21. Each spring is made of spring steel coated with zinc and is three (3) inches long with an outside diameter (O.D.) of $\frac{3}{8}$ inch. They are confined within an eleven (11) inch space within the housing and, hence, are compressed somewhat. When uncompressed the springs have a pitch of eleven (11) turns per inch. The end of each spring touches the preceding turn so that each spring has a loop at its end.

In a mobil antenna, raising the loading coil raises the radiation pattern and allows the vehicle body to serve as an effective ground plane, i.e. it becomes more efficient. The arrangement of four springs effectively accomplishes the same thing. Also, an appreciable part of the radiation is emitted from the loading coil. Therefore, a series of four spring coils spreads the radiation over a greater distance above the ground plane, thereby giving a better radiation pattern because less of the radiation is blocked by the vehicle body. Also, since each individual spring has a good form factor the loading coil has a reasonably good Q. In addition, the spacing of the turns of a spring reduces the inter-turn capacitance and, hence, raises the Q.

Tests on the four-spring antenna show it to have superior performance over the 23 C.B. channels. In particular, it has a VSWR of 1:1.05 over this range. This compares with a similar VSWR for only 5 C.B. channels with the most efficient (highest Q) of the known commercial C.B. base-loaded antennas and a VSWR of 1:6 over the entire C.B. band for the best known commercial helical antenna. In addition, tests with a single spring of equivalent length or of several springs coated with a different material, e.g. silver, produce acceptable, but less satisfactory results.

The exact reason why the four-spring antenna operates better than the single equivalent spring antenna is not known. However, it has been noted that the four springs are more compressed at their ends (35–39). In fact several turns of each spring are short circuited at these points. The result is to create a higher capacitance region to ground on both ends of each spring. Also a discontinuity in the inductances of the coil is created, i.e. the coil appears as a series connection of inductances with capacitance to ground associated with each connection. This network is probably responsible for the wide bandwidth of the antenna. Microwave antennas in the leaky-wave family, e.g. Polyrod, Zigzag, Holey Plate and Mushroom, operate on a similar discontinuity principle.

Additionally, the separation of inductances of the springs creates four loading coils arranged from the bottom to the center of the antenna. The form factor of each of these coils is such that they each have a good Q and, hence, the entire antenna system has a good Q. This may be responsible for the good VSWR.

The wide band characteristics of the antenna of the invention eliminates the need to re-tune the antenna for optimum VSWR over the entire C.B. band of 26.96 to 27.4 MHZ. Where tuning is desired, however, it may be accomplished by adjusting the position of the whip 12 so as to raise or lower it or to change the compression on the four springs as was explained in connection with FIG. 1. Compressing the springs increases the inductive reactance, thus causing the antenna to resonate at a lower frequency. Alternatively, the antenna can be tuned by changing the length of the whip without affecting the spring compression by cutting off pieces of the whip.

Figure 3:
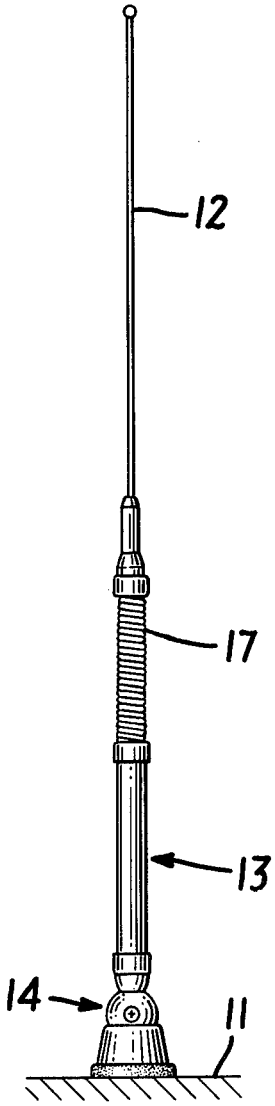
FIG. 3 is an illustrative embodiment in which a mounting spring is located above the loading coil.

In FIG. 3 the antenna of FIG. 1 is shown with the mounting spring 17 shifted to a position between the whip 12 and the loading coil 13. In this embodiment the loading coil tends to maintain its vertical position, like the antenna of FIG. 2, while the whip is allowed to flex.

While the invention has been particularly shown and described with reference to preferred embodiments thereof, it will be understood by those skilled in the art that various changes in the form and details may be made therein without departing from the spirit and scope of the invention. In particular, the springs used may be made from different materials and designed with different dimensions from those disclosed, and still come within the scope of the appended claims. If the springs are dimensioned so as to increase the total inductance, the antenna of the present invention becomes useful at lower frequencies and is effective in the Ham, Military, International Short Wave and Communication bands. Also, the antenna can be used at a stationary transmitter when it is desired to save space.

I claim:

1. A transmitting and receiving antenna having a whip-like elongated conducting rod, a loading coil and a mounting structure, which are mechanically and electrically connected in series and adapted to be mounted above a ground plane, said loading coil being designed to match the antenna impedance presented by the cable and to adjust the equivalent electrical length of the radiation for which the antenna is adapted, characterized in that the loading coil comprises:

an inductive element in the form of four helical springs, said springs being placed in series and touching one another;

a housing for said springs having non-conducting sides and enclosing a space having a cross section substantially the same size as the outside diameter of said springs and a thickness sufficient to support said springs against buckling, said housing having a length somewhat shorter than the overall length of the springs so as to compress their length; and conducting end pieces located on either end of said housing, one each of said end pieces being connected to said rod and said mounting structure respectively, the ends of the series of springs being in contact with said end pieces without being attached thereto so as to improve its VSWR over a frequency range.

2. An antenna as claimed in claim 1 wherein said four helical springs are each constructed from spring steel plated with zinc and have a three (3) inch length, a $\frac{3}{8}$ inch outside diameter and a pitch of eleven (11) turns per inch, and said housing has an interior length of approximately eleven (11) inches within which said four springs are compressed.

3. A transmitting and receiving antenna structure having an antenna section in the form of a whip-like elongated conducting rod, a loading coil and a mounting structure, which are mechanically and electrically connected in series and are adapted to be mounted above a ground plane and attached to an output cable, the loading coil being electrically connected between the antenna section and the cable and being designed to match the antenna impedance to the impedance presented by the cable and to adjust the equivalent electrical length of the antenna section to a certain fraction or multiple of the wave length of the radiation for which the antenna is adapted, characterized in that the loading coil comprises:

at least one inductive element in the form of a helical spring;

a housing for said spring having non-conducting sides and enclosing a space having a cross section substantially the same size as the outside diameter of said spring and a thickness sufficient to support said spring against buckling, said house having a length somewhat shorter than the spring so as to compress its length; and conducting end pieces located on either end of said housing, one of said pieces being connected to said rod and the other being connected to said mounting structure, said at least one spring being in contact with said end pieces without being attached thereto so as to improve its VSWR over a frequency range, said one end piece connected to the rod includes, (a) a mounting member defining a passage through which the end of said rod extends into said housing, (b) a conducting plate within said housing and connected to said rod, said plate being in contact with one end of said spring and being movable in the longitudinal direction of said housing so as to change the compression of the spring, and (c) a fastener means for fixing the position of said rod relative to said mounting member, thereby tuning the antenna to a particular frequency range and varying its impedance.

* * * * *